US007987597B2

(12) United States Patent
Pinkerton

(10) Patent No.: US 7,987,597 B2
(45) Date of Patent: Aug. 2, 2011

(54) SYSTEMS AND METHODS FOR THE AUTOMATED FABRICATION OF TRUSSES

(75) Inventor: Joseph F Pinkerton, Austin, TX (US)

(73) Assignee: CJP IP Holdings, Ltd., Austin, TX (US)

( * ) Notice: Subject to any disclaimer, the term of this patent is extended or adjusted under 35 U.S.C. 154(b) by 113 days.

(21) Appl. No.: 12/345,013

(22) Filed: Dec. 29, 2008

(65) Prior Publication Data

US 2009/0106979 A1 Apr. 30, 2009

Related U.S. Application Data

(63) Continuation of application No. 11/155,954, filed on Jun. 17, 2005, now Pat. No. 7,484,289.

(60) Provisional application No. 60/581,253, filed on Jun. 17, 2004, provisional application No. 60/587,885, filed on Jul. 13, 2004.

(51) Int. Cl.
*B23P 15/00* (2006.01)
*B23P 21/00* (2006.01)

(52) U.S. Cl. ..... 29/897.31; 29/281.3; 100/913; 227/101; 227/152; 269/910

(58) Field of Classification Search ..... 29/897.31, 29/897.312, 281.3; 100/913; 269/910; 227/101, 227/152; 198/619
See application file for complete search history.

(56) References Cited

U.S. PATENT DOCUMENTS

| | | | | |
|---|---|---|---|---|
| 1,343,648 | A | | 6/1920 | Smith |
| 3,178,620 | A | | 4/1965 | Berker |
| 3,390,627 | A | | 7/1968 | Levkovitz |
| 3,610,695 | A | | 10/1971 | Yabuta |
| 3,629,931 | A | * | 12/1971 | Stanley ..... 29/432 |
| 3,662,635 | A | | 5/1972 | Yabuta |
| 3,675,757 | A | | 7/1972 | Yabuta |
| 3,749,391 | A | | 7/1973 | Templin |
| 3,752,467 | A | * | 8/1973 | Stanley ..... 269/910 |
| 3,765,587 | A | * | 10/1973 | Davis ..... 227/152 |
| 3,785,277 | A | | 1/1974 | Scmitt |
| 3,811,578 | A | | 5/1974 | Jureit et al. |
| 3,915,444 | A | | 10/1975 | Moehlenpah |
| 4,005,520 | A | | 2/1977 | Sanford |
| 4,071,061 | A | * | 1/1978 | Schneider ..... 100/913 |
| 4,174,061 | A | * | 11/1979 | McDonald ..... 269/910 |
| 4,238,658 | A | | 12/1980 | Kalnin |
| 4,304,046 | A | * | 12/1981 | McDonald ..... 29/798 |
| 4,376,362 | A | | 3/1983 | Jackson |
| 4,453,705 | A | * | 6/1984 | McDonald ..... 100/913 |
| 4,567,821 | A | * | 2/1986 | McDonald ..... 100/913 |

(Continued)

FOREIGN PATENT DOCUMENTS

DE 102006020413 A1 11/2007

(Continued)

*Primary Examiner* — Erica E Cadugan
(74) *Attorney, Agent, or Firm* — Kramer Levin Naftalis & Frankel LLP

(57) ABSTRACT

An automated fabrication system is provided that utilizes electromagnetism to manipulate and/or sense the location of raw materials on a platform. Tools located around said platform may be utilized to fabricate a predetermined structure out of the raw materials. Tags that can be electromagnetically manipulated and sensed may be placed on passive raw materials. Structures fabricated from such a system may be, for example, a roof truss. Additionally, the fabrication system may be mobilized by way of a truck such that structures may be built on-site.

20 Claims, 16 Drawing Sheets

U.S. PATENT DOCUMENTS

| | | | | |
|---|---|---|---|---|
| 4,704,568 | A | 11/1987 | Beck et al. | |
| 4,841,852 | A * | 6/1989 | Kubiak et al. | 100/913 |
| 5,092,028 | A | 3/1992 | Harnden | |
| 5,414,918 | A * | 5/1995 | Pearson | 29/33 K |
| 5,435,476 | A * | 7/1995 | Simpson | 29/822 |
| 5,439,207 | A | 8/1995 | Schleicher | |
| 6,318,251 | B1 * | 11/2001 | Schulz | 100/913 |
| 7,559,147 | B2 * | 7/2009 | Fleeman | 29/897.31 |
| 2006/0011074 | A1 | 1/2006 | Pinkerton | |

FOREIGN PATENT DOCUMENTS

| | | | |
|---|---|---|---|
| EP | 0 452 137 | | 10/1991 |
| FR | 2 339 441 | | 8/1977 |
| FR | 2693148 | A1 * | 1/1994 |
| GB | 1432615 | A * | 4/1976 |
| WO | WO 2006/100339 | A1 | 9/2006 |

* cited by examiner

SYSTEMS AND METHODS FOR THE AUTOMATED FABRICATION OF TRUSSES

CROSS-REFERENCE TO RELATED APPLICATIONS

This application is a continuation of U.S. patent application Ser. No. 11/155,954, filed on Jun. 17, 2005, now U.S. Pat. No. 7,484,289, which claims the benefit of both U.S. Provisional Patent Application No. 60/581,253 filed on Jun. 17, 2004, and U.S. Provisional Patent Application No. 60/587,885, filed Jul. 13, 2004, each of which is hereby incorporated by reference herein in its entirety.

BACKGROUND OF THE INVENTION

This invention relates to the fabrication and distribution of trusses. Particularly, this invention relates to the automated fabrication of trusses.

Trusses (e.g., roof trusses) are often used to distribute the weight of a structure (e.g., a roof) to a different structure (e.g., one or more walls). Trusses are used, for example, in roofs, bridges, bi-planes, and towers. Particular configurations of roof trusses include, for example, Pratt, Warren, Fink, Bobtail, Double W, Fan, Flat Top, Scissors, Raised Tie, Inverted, Extended Tie, and Howe truss configurations.

Traditional trusses are manually fabricated at truss factories. Manual construction of trusses is expensive and time-consuming. It is therefore desirable to develop truss fabrication systems and methods that can fabricate a truss at a lower cost and at a faster speed.

Completed trusses are then traditionally moved (e.g., by truck) to specific build sites. Because a large amount of open-space is present in a completed truss, only about 10% of a truck is actually filled by the truss. In this manner, roughly 90% of the load of a traditional truss-carrying truck is air. It is therefore desirable to improve the method of distributing trusses to build sites and construct distribution systems for the same.

SUMMARY OF THE INVENTION

It is an object of the present invention to provide systems and methods for the automated fabrication of trusses.

It is another object of the present invention to provide a mobile fabrication system that can autonomously fabricate any type of truss, or other structure (e.g., framing structures).

In one embodiment, a fabrication platform is provided that is constructed from multiple magnetic tiles. Tags (e.g., steel and/or copper tags) are embedded in, or attached to, the material used to build the truss (e.g., lumber or steel). The magnetic tiles may then interact with the tags such that the building material is located, moved, and worked upon. For example, one or more magnetic tiles can locate a 2×4 piece of wood, move the 2×4 piece of wood across the platform to a press, and clamp the 2×4 piece of wood to the platform so that the 2×4 piece of wood can not move. After the 2×4 piece of wood is pressed to, for example, a truss connector (e.g., a metal toothed truss connector plate), the 2×4 piece of wood can be moved by one or more magnetic tiles to the next fabrication step. Such an embodiment may provide a low-cost, high-speed truss fabrication system in which the truss may be moved on a magnetic "cushion" for frictionless movement (e.g., a low-damage environment).

In addition to use the interaction between the magnetic tiles and tags to create a "cushion" for frictionless movement, additional mechanical operations can be can be performed on a building material (e.g., a truss member) having a tag. As stated, the building material can be magnetically stabilized in a position and locked to an assembly platform so that additional operations can be performed. Such an operation can be used, for example, to cut a truss member, connect multiple truss members together, or drill holes into truss members at pre-determined locations so that water pumps and/or electrical wiring may be routed through the drilled hole. As per another example, the truss member can be magnetically flipped so that a different surface of the truss member is facing the working platform. Such an operation may be used, for example, to paint a truss member.

A mobile fabrication factory is also provided. Particularly, a vehicle such as a truck may be configured to include a magnetic platform. This truck may be loaded with a raw building material (e.g., twelve 2×4s that are ten feet long). At the build site, instructions for a particular structure (e.g., a Bobtail roof truss) may be provided to the mobile fabrication facility. The mobile fabrication facility may then look up a design process (e.g., a list of design process steps or machine process steps) in accordance with these instructions (e.g., a Bobtail roof truss build order) and may autonomously use the design process to build the desired structure. One of the many advantages associated with such a mobile fabrication facility is that a single truck can transport more trusses to a build site as the raw building materials take up significantly less space in the truck than completed trusses. As such, significantly more trusses can be delivered per truck.

A variety of other magnetic and non-magnetic fabrication systems and methods are also provided.

DETAILED DESCRIPTION OF THE INVENTION

U.S. Patent Publication No. 2006/0011074 entitled "Systems and Methods for Connecting Truss Connector Plates to Truss Members" published Jan. 19, 2006, is hereby incorporated by reference herein in its entirety.

Figure 1:
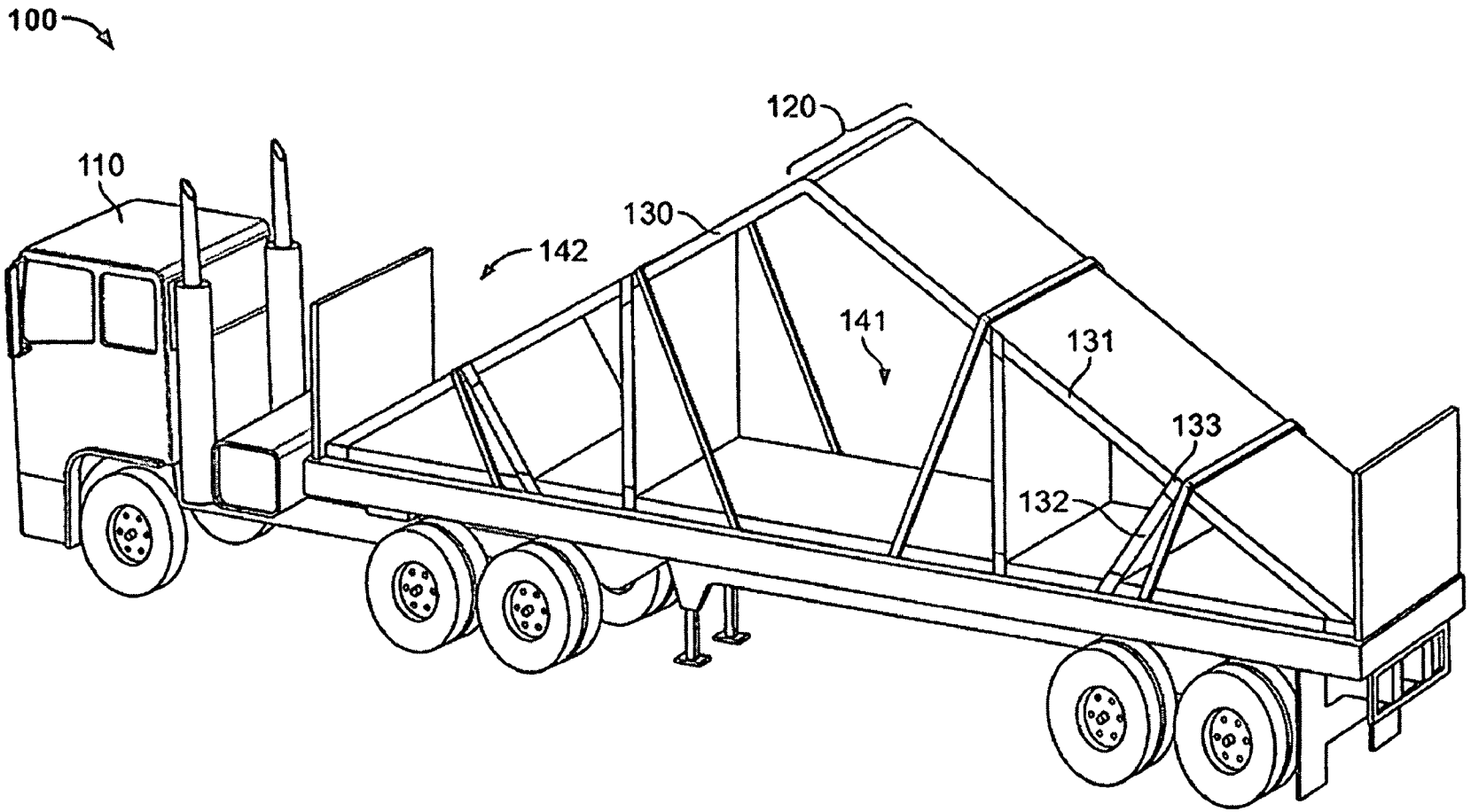
FIG. 1 (Prior Art)
FIG. 1 is an illustration of a prior art truss transportation system.

FIG. 1 shows prior art truss transportation system 100 that includes truck 110 transporting truss bundle 120. Truss bundle 120 includes multiple trusses. Each truss is manually fabricated from a variety of truss members (i.e., members 130, 131, and 132) that are secured together by truss connectors (i.e., connector 133). Up to approximately 90% of the storage capacity of truck 110 may comprised of air (i.e., empty space 142 and 141) as a result of the large area needed to store truss bundle 120.

Figure 2:
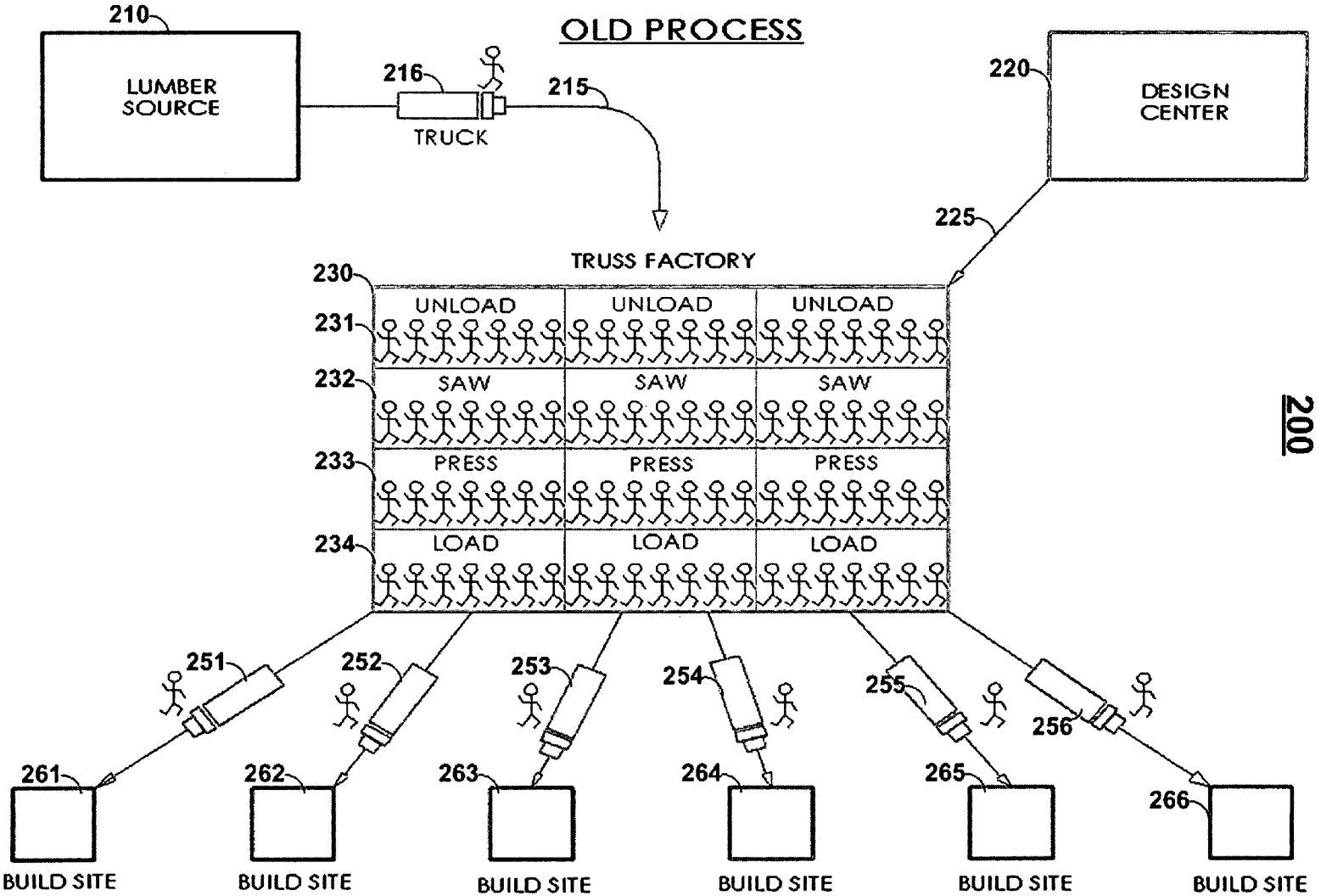
FIG. 2 (Prior Art)
FIG. 2 is an illustration of a prior art truss fabrication and distribution process.

FIG. 2 shows a prior art truss fabrication process 200 that includes lumber source 210, design center 220, and truss factory 230. Raw material used to fabricate trusses is manually transported by truck 216 from lumber source 210 to truss factory 230 via path 215. Path 215 may be several hundred miles long. Next, paper designs that are needed to build particular truss may be manually transported, or faxed, via path 225 to truss factory 230. Inside truss factory 230, the raw material is unloaded in step 231 and sawed into the needed truss members in step 232. These truss members are then connected together by pressing a truss connector across portions of the truss members in step 233. In step 234, the finished structures are then loaded onto trucks 251-256, where each of truck 251-256 travel to a different build site 261-266, respectively. Most, if not all, steps in prior art truss manufacturing process 200 are performed manually. Furthermore, if more than one truss has to be constructed at the same time, at least one additional manual construction team must be utilized. Moreover, a large number of trucks are needed to distribute the trusses since the trusses take up a large amount of area once the trusses are built. Additionally, very little flexibility exists after the completed trusses are shipped. If even a minor adjustment is needed on a truss at a particular building site, the entire process must be started from the beginning (i.e., lumber source 210).

Figure 3:
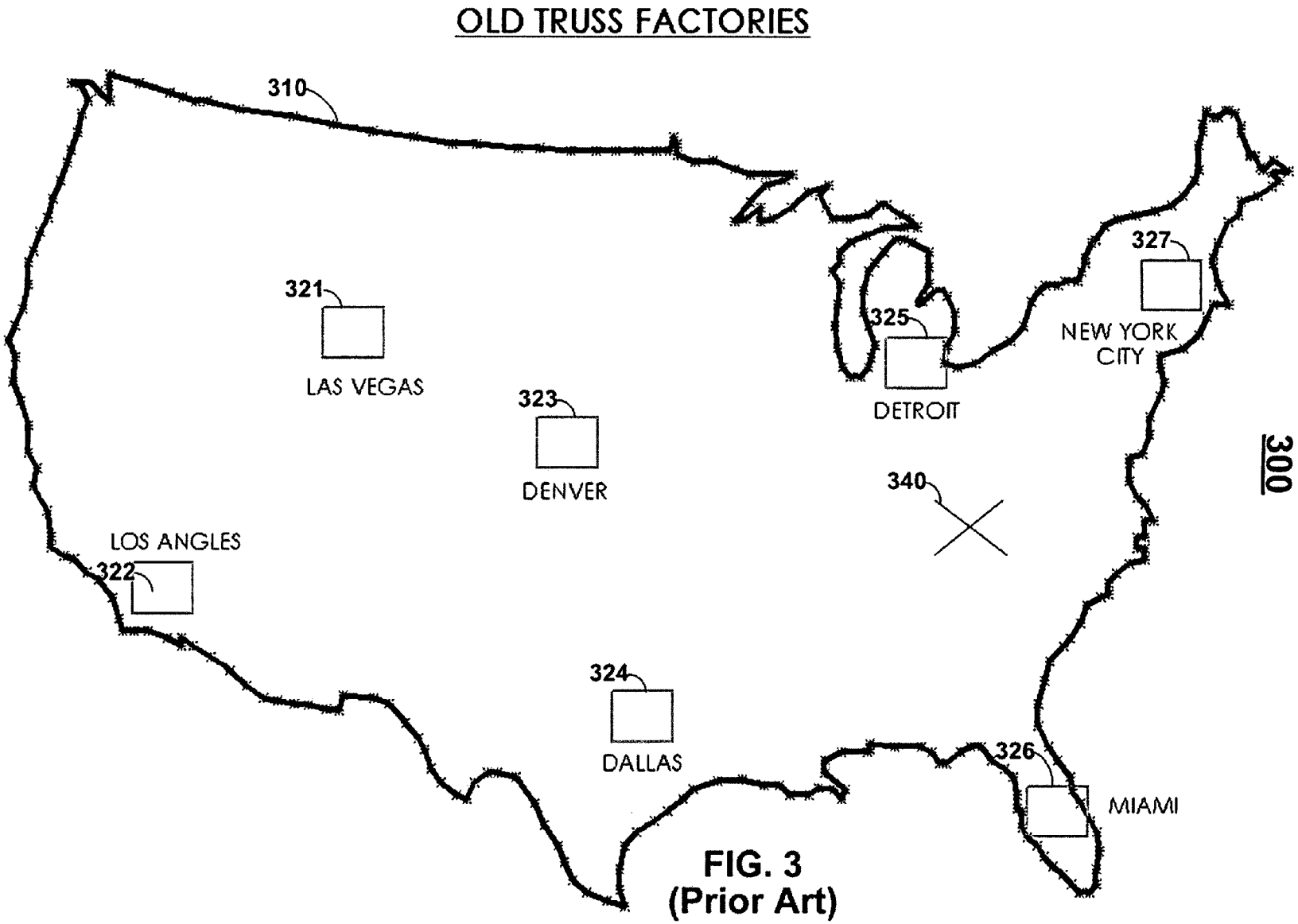
FIG. 3 (Prior Art)
FIG. 3 is a topology of the locations prior art truss factory locations in the United States.

FIG. 3 shows truss factory network 300 in which truss factories 321-327 are permanently located at a fixed position on map 310. Network 300 depicts another problem inherent in a traditional truss distribution system. If a truss is needed at building site 340, then additional steps are required such as determining which of nearby factories 323-327 is able to deliver a truss and which truck, from a limited number of trucks, should be sent to the nearby factory to retrieve the completed truss. Furthermore, the amount of construction in particular parts of the United States changes throughout the year. For example, in the winter, the amount of building in Maine may be dramatically decreased while the amount of building in Florida may be the same. However, in the summer, the amount of building in Maine may be the same as the amount of building in Florida. As a result of the truss factories being fixed in a permanent location, more demand may be placed, by a building site, on remote truss factories. The transportation of a truss from a remote factory increases cost. This either translates into a higher cost to the consumer for the construction project or a loss in profit for the contractor.

Figure 4:
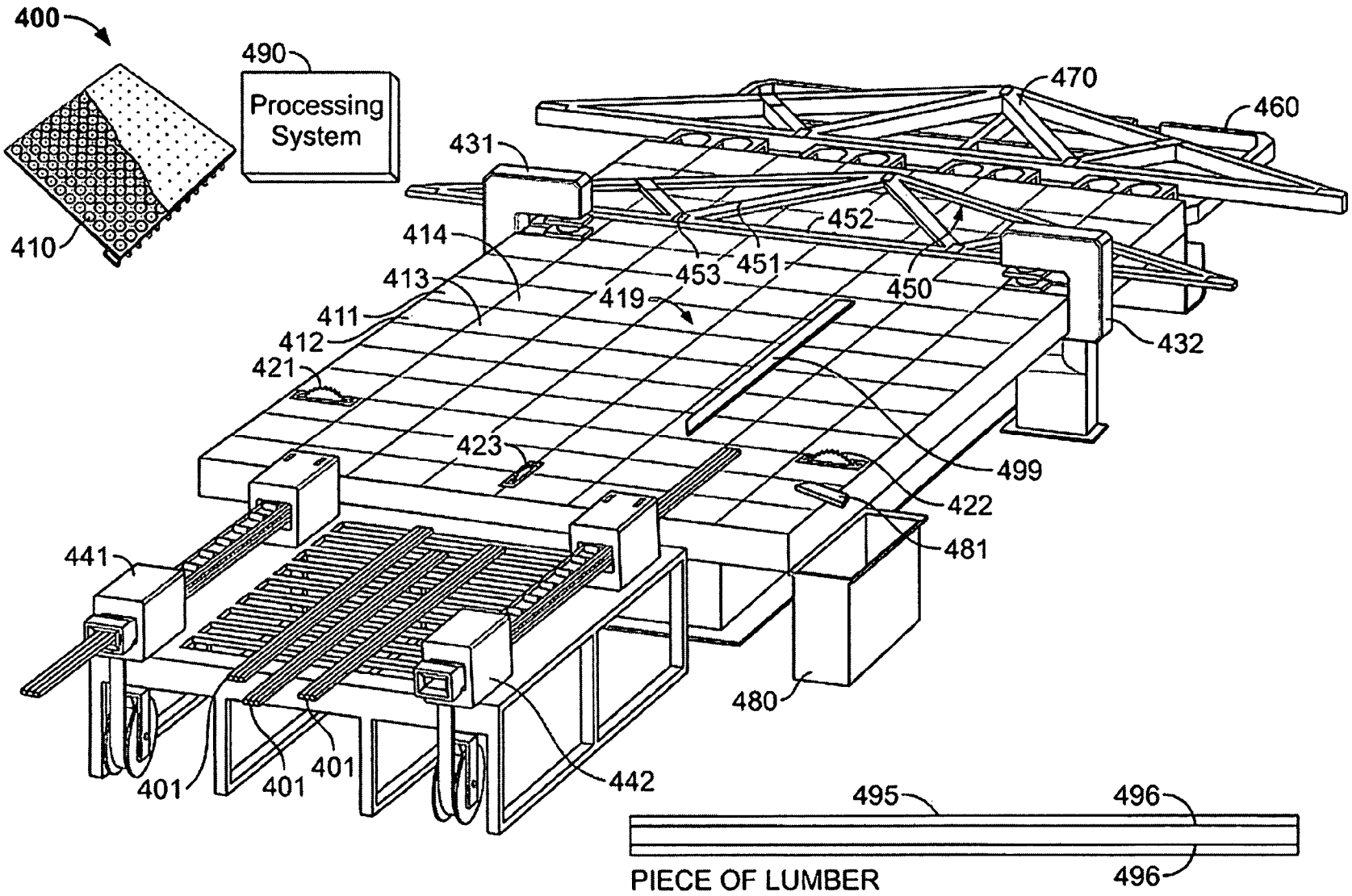
FIG. 4 is an illustration of a truss fabrication system constructed in accordance with the principles of the present invention.

FIG. 4 shows automated manufacturing system 400 constructed in accordance with the principles of the present invention. Manufacturing system 400 includes platform 419 which may be formed by any number of magnetic tiles 410. For example, magnetic tiles 410 may each be placed at positions 411-414 to form a two-tile by two-tile portion of platform 419.

Magnetic tiles 410 interact with tagged material 499. Magnetic tiles 410 may, for example, raise tagged material 499 up from the surface of platform 419, clamp tagged material 499 down to the surface of platform 419 (e.g., securing tagged material 499 to platform 419), sense the position of tagged material 499, and move tagged material 499 across platform 419 to a particular position on platform 419.

Generally, magnetic tiles 410 provide an electromagnetic force against tags either embedded in raw material 401 or attached to material 401. Such an electromagnetic force may be utilized to attract or repel the tags from the source of the electromagnetic force (e.g., one or more magnetic tiles). Such tags may be, for example, steel or copper tags. A more detailed discussion as to how magnetic tiles 410 operate (and interact with tags) is included below in connection with the discussion of FIGS. 5 and 6.

Raw material or tagged materials 401 (e.g., wood or light gauge steel) may be manually or autonomously placed near or in devices 441 and 442. Such raw materials may be autonomously fed into, or autonomously obtained by, devices 441 and 442. Devices 441 and 442 may feed raw materials 401 to a particular spot on platform 419 at a particular time. If raw materials 401 have not yet been tagged, devices 441 and 442 may also tag raw materials 401. For example, devices 441 and 442 may attach tags to raw materials 401 (e.g., by gluing tags to, pressing tags into, placing tags around, or folding tags around raw materials 401). The tags may be placed at any position on a raw material. For example, if the raw material is a 2×4 piece of wood, then tags may be placed at each end of the 2×4 and a third tag (or cluster of tags) may be placed directly at the middle of the 2×4. Alternatively, the tags may be placed uniformly across the 2×4 (e.g., every six inches). Alternatively, the tags may be placed continuously across the 2×4 (e.g., continuous tag lines 496 on lumber piece 495). Such tags may be applied via a paint (e.g., a steel paint) such that lumber piece 495 may be cut at any position. Persons skilled in the art will appreciate that if the raw material being used is, for example, steel or copper than the magnetic forces of magnetic tiles 410 may act directly on the work piece (e.g., raw material).

Once a tagged material is placed onto platform 419, magnetic tiles 410 may manipulate the tags in/on the material. For example, tagged material may be manipulated to a position and layout representative of the position and layout of tagged material 499. Thus, a tagged material may be brought to any particular device on/near platform 419.

Figure 15:
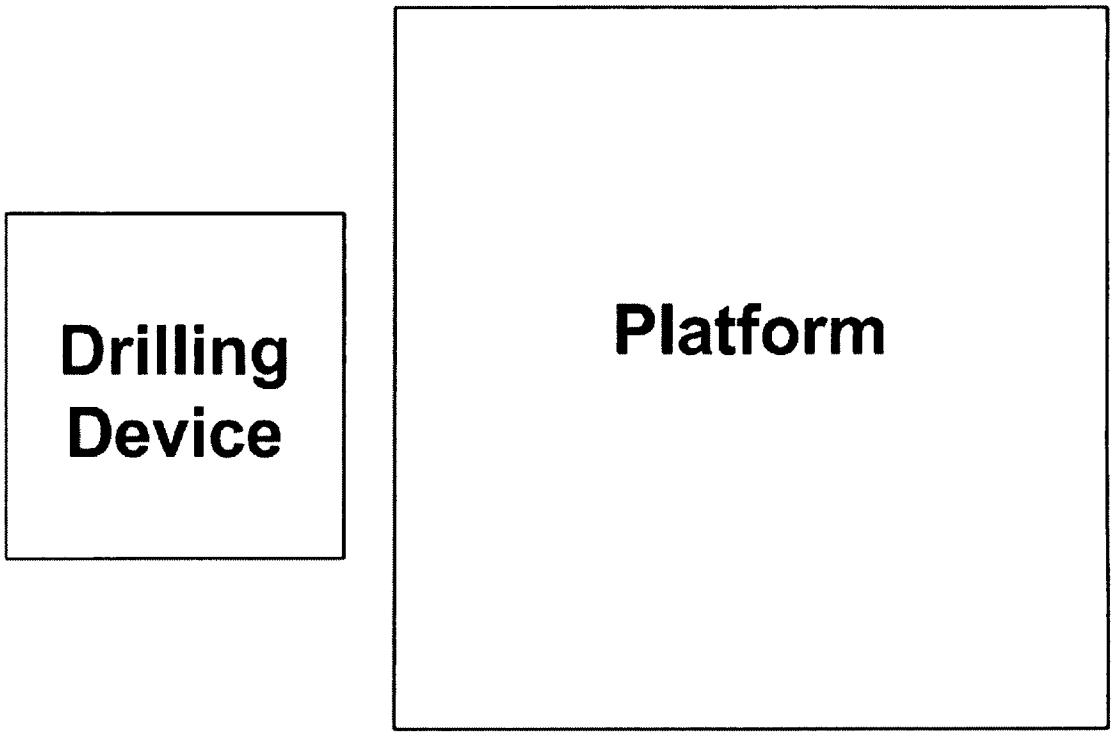
FIG. 15 is a schematic view showing a drilling device positioned for use with a platform according to the present invention.

Tagged material 499 may be, for example, moved to a cutting tool (e.g., tools 421-423). When tagged material 499 gets close to a cutting tool, the magnetic tiles near the cutting tool may clamp tagged material 499 to platform 419 so that tagged material 499 does not move. Cutting tool 419 may then perform a cut into tagged material 499. Because the position of tagged material 499 is known as a result of the magnetic tiles, or other sensing method, the position of raw material 499 may be forwarded to, and the knowledge utilized by, the cutting tool (e.g., by processing system 490). Alternatively, a cutting tool may always be ON and magnetic tiles may move tagged material 419 through the cutting tool in a particular fashion in order to obtain a particular cut into tagged material 419. Persons skilled in the art will appreciate that many different types of tools (e.g., welding, binding, soldering, drilling, painting, or refining tools) may be included about platform 419. For example, FIG. 15 shows a schematic view illustrating some embodiments in which a drilling device may be positioned for use with the platform.

Any scrap material from a process, such as scrap material 481, may be sensed and moved to waste container 480. For example, scrap material 481 may be accelerated/moved towards waste container 480 such that scrap material 481 falls off, or is projected off, the side of platform 419 into waste container 480.

One useful tool in building roof trusses is a pressing machine. As a result, one or more pressing machines may be positioned about platform 419 (e.g., pressing machines 431 and 432). Pressing machines may be used, for example, to press connectors into two separate pieces of raw material to fix the two pieces together. Such connectors occasionally have a large number of teeth and pressing the teeth into a raw material may secure the connector to that raw material. For example, connector 453 may be utilized to connect truss members 451 and 452 together. Pressing systems, such as pressing machines 431 and 432, may be utilized to press a single connector into any number of truss members (e.g., three).

The length and cut of a tagged material may be sensed. If, for example, the size and shape is appropriate, then the tagged material may be placed under pressing machines 431 and/or 432 (e.g., C-clamp presses). Such a tagged material may be aligned with other tagged materials, into a particular configuration, under the pressing machines. The configuration of tagged materials may be then by clamped to platform 419 via an interaction with the magnetic tiles and tags. Such pressing machines may then press one or more connectors into the configuration of tagged materials. For a truss fabrication process, the magnetic tiles of platform 419 may move the raw materials into a truss configuration, or a portion of a truss configuration, and press connector plates into the configuration to keep the configuration in-place. The connectors (e.g., toothed metal connector plates) may be fed to machines 431 and 432 either manually (e.g., in bundles) or may be moved to a particular position in pressing machines 431 and 432 or on platform 419 by magnetic tiles 410. Such connectors are usually fed into a pressing machine in pairs such that a pressing machine may sandwich the connectors about a truss joint. Pressing machines 431 and 432 may be operable to provide a very large amount of pressure (e.g., approximately 100,000 pounds of pressure).

Persons skilled in the art will appreciate that the electromagnetic fields generated by tiles 410 may be utilized to interact with numerous components other than truss members, connector plates, or tags. For example, pressing system 431 can have a power switch (e.g., a secondary power switch) that faces towards a particular section (e.g., a quadrant) of tile 410. System 400 can be configured such that the location of this switch is stored in memory and associated to the quadrant associated to the switch. Half of the switch may be non-conductive while, for example, the other half of the switch is made of steel (i.e., a material interactive with the electromagnetic force of platform 419). As such, platform 419 can manually operate controls on pressing system 431. In this manner, system 400 may include off-the-shelf components. The manual controls of these components can be changed to have controls that can be manipulated by tiles 410. As such, tiles 410 can be configured about system 400 in any manner. For example, a tile may be placed perpendicular to platform 419 and behind and parallel to pressing system 431 such that the controls of pressing system 431 may be utilized. Alternatively, the processor(s) controlling system 400 can be spliced into the communications lines of any off-the-shelf systems and be configured to control such controls.

Persons skilled in the art will appreciate that multiple platforms 419 can be coupled together to form a configuration of platforms. One such configuration can take the form of a closed box or an open chute. Thus, materials having tags (or electromagnetically reactive to magnetic tiles) can be worked on in a three-dimensional space (e.g., rotated in any three-dimensional direction). Additionally, the configuration of two platforms facing each other allows both sides of a truss member to be operated on without the need to flip the truss member over.

The process of cutting, moving, positioning, and clamping raw materials (and already completed structure sections) continues until a completed structure has been completed (e.g., truss 450). Next, the completed structure may be moved by magnetic tiles 410 to loading area 460. For example, truss 450 may be moved on top of truss stack 470. Truss stack 470 may sit on moveable shelf 460. Such a shelf may be raised and lowered such that the top of stack 470 is substantially in-line with the surface of platform 419. In this manner, truss 450 may smoothly be moved onto the top of stack 470 without causing any damage to stack 470 or truss 450.

Processing circuitry 490 may be included to operate the process steps of system 400. Particularly, processing circuitry 490 may receive instructions from an external source, process these instructions, and provide related control signals to the components of system 400. For example, an operator may enter, via a Graphical User Interface (GUI) a desired truss configuration. Such a configuration may include, for example, the type, height, width of the configuration as well as the type of building materials are to be used to construct the truss. Alternatively, instructions may be communicated to processing circuitry 490 remotely by way of, for example, a modem, the internet, an intranet, a wireless modem, WiFi, radio transmissions, infrared transmissions, cellular transmissions, or through a direct satellite communications.

Processing circuitry 490 may also be connected to one or more databases that store computer code with how to receive and read communications and provide control signals to the components of system 400. Such a database may also contain a set of rules for the operation of system 400. In this manner, new processes may be stored in the database and may be called up, for example, by an operator. Such rules may also include safety constraints and communications protocols for the components of system 400. Such a database can be remote from system 400 and can communicate with processing circuitry 490 remotely (e.g., wirelessly or through the internet). In this manner, if system 400 is mobile, an administrator can update the rules present in the remote database such that the mobile fabrication system can utilize such rules when fabricating structures (e.g., trusses). Processing circuitry 490 may be configured to, for example, check with the remote database at a particular time period (e.g., midnight) or at a particular event (e.g., turn ON) to see if any new instructions/updates are present in the remote database. Similarly, the remote database (via remote processing circuitry such as a server) may transmit a message to processing circuitry 490 telling processing circuitry 490 that a software update is present.

Figure 5:
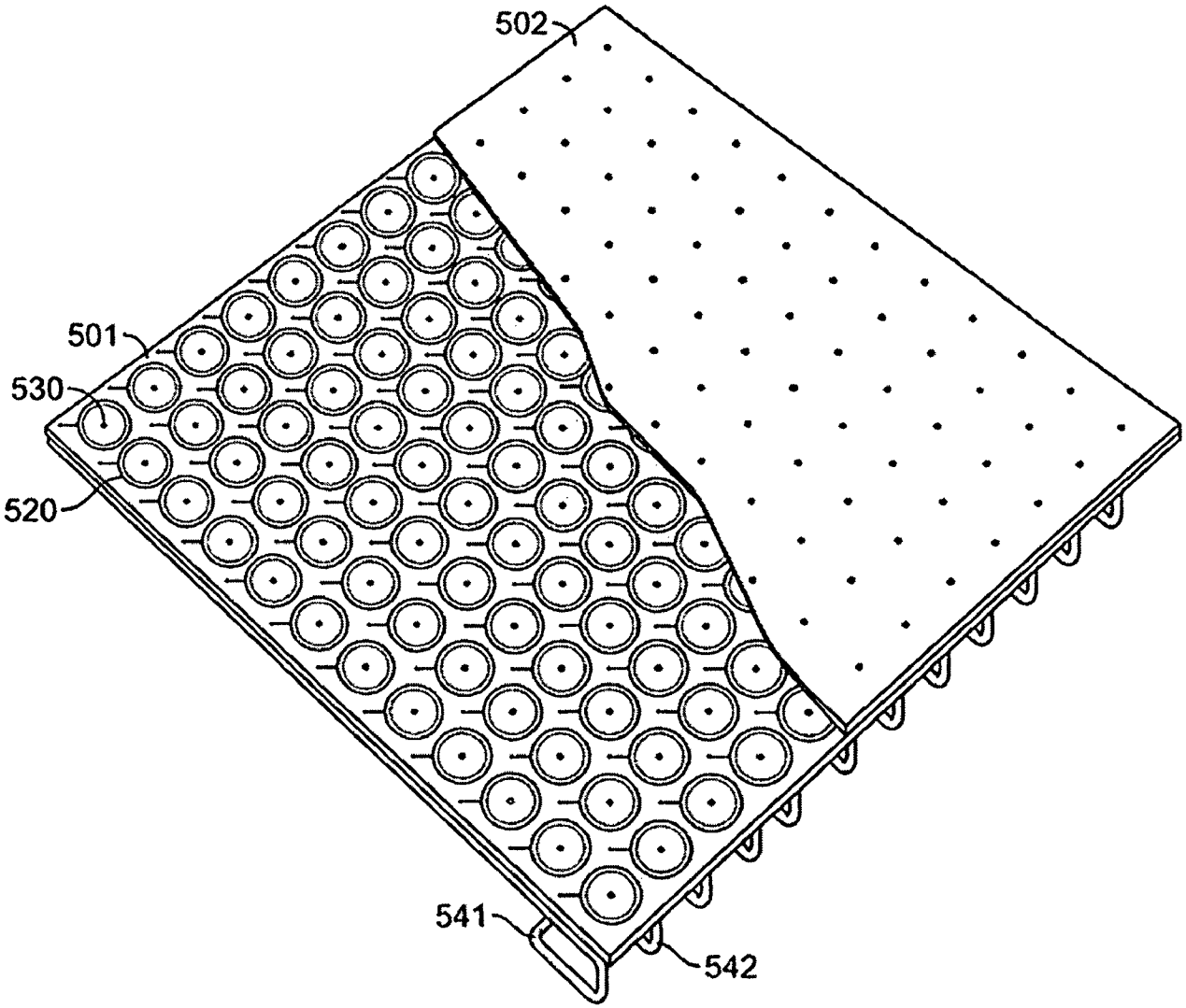
FIG. 5 is an illustration of a magnetic tile constructed in accordance with the principles of the present invention.

FIG. 5 shows magnetic tile 500 which can include plate 501 and protective covering 502. Any number of coils 520 may be embedded in, or fabricated/laid on, plate 501. For example, as shown in magnetic tile 500, twelve rows of twelve coils 520 may be included on plate 501. Plate 501 may be, for example, a steel plate. Coils 520 may be supplied power either individually, or in groups, by wiring (e.g., wiring 541 and 542). The operation of magnetic tile 500 may be controlled by, for example, processing circuitry (e.g., processing circuitry 490 of FIG. 4). Protective covering 502 may be, for example, a polymer.

Figure 16:
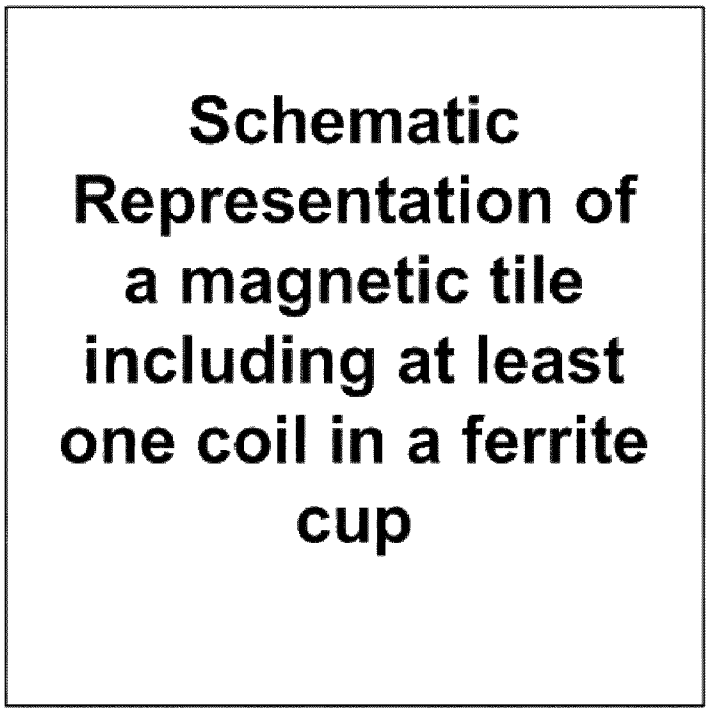
FIG. 16 is a schematic representation of a magnetic tile including at least one coil in a ferrite cup.

Persons skilled in the art will appreciate that coils 520 and plate 501 may take a form other than the one illustrated in system 500 of FIG. 5. For example, copper coils may be provided in ferrite cups, as illustrated in FIG. 16. Such ferrite cups may be embedded in an aluminum tile in order to, for example, minimize AC core losses. Similarly, a single plate 501 may include a single coil. Alternatively, multiple rows of coils may be included on a single plate and controlled by one or more power and control systems. Each row may be controlled independently of the other. Additionally, each coil in a plate may be controlled independently from one another by, for example, providing individual control wiring to each coil.

To sense a position of a tag embedded in a raw material (or a raw material constructed from a "tag" material), a small AC voltage/current (e.g., approximately 1 kHz) can be injected into one or more coils. If there is a phase shift present in the current relative to the applied voltage then the coil is in the presence of a magnetic, or electrically conductive, material (e.g., a steel or copper tag). Circuitry to sense such a phase shift may be included on, or may be coupled to, magnetic tile 500 to determine, for example, the location of tags and/or truss members in the proximity or a portion of tile 500.

To levitate a tag (e.g., levitate a tagged material), a relatively HIGH AC current can be injected into one or more coils of magnetic tile 500. A copper, or, for example, an aluminum tag may react to such a HIGH AC current by providing an eddy-current repulsion force. Persons skilled in the art will appreciate that more than one type of tag may be provided on a single raw material. Alternatively, one or more types of material may be used to fabricate a single tag. For example, half of a tag may be copper while the other half of the tag is steel. If a platform is inverted (e.g., system 700 of FIG. 7) then the electromagnets (e.g., magnetic tiles 500) may be utilized to levitate a steel tag (or steel truss member) against gravity. Advantageous functionality can be obtained by attracting working materials against gravity in an inverted platform.

One such advantage is that the platform can be inverted over a large trash receptacle. Thus, for example, when a truss member is cut, any unused portions as well as cutting byproducts (e.g., wood chips) can fall with gravity to the ground and into the trash receptacle. Such a trash receptacle can be located on tracks and moved along these tracks by a control system such that when the trash receptacle is full (as determined by, for example, a sensor), the trash receptacle is moved. The trash receptacle can be moved outside of the facility and dumped into a larger receptacle or left outside for pickup.

To move a tag (e.g., move a material having a tag), the electromagnets may "pull" on the leading edge of a steel tag (or steel truss member) such that, for example, a horizontal and a vertical pulling force is applied to the leading edge of the tag or magnetic material. Such a "pulling" force may be, for example, provided by injecting a DC voltage/current through one or more coils. For example, a first group of coils may sense magnetic tile 500 by exposing the trailing edge of a tag to a relatively SMALL AC signal while control circuitry determines the phase shift. A second group of coils may then pull on the leading edge of the tag. In more sophisticated embodiments, a third group of coils may push (via a HIGH AC) yet another portion of a tag.

If a copper tag (or any electrically conductive tag) is provided adjacent to a steel tag (or any tag fabricated from a magnetic material) then the mobility (e.g., the linear acceleration) of a raw material may be increased. If a relatively HIGH AC current/voltage is injected into coils near the inside of the leading edge of the copper tag (e.g., the portion of the leading edge on the side of the copper tag) then a substantially vertical pushing force may be applied to the portion of the raw material attached to this leading edge. Furthering this example, if a steel tag is placed adjacent to the copper tag and a substantially DC current/voltage is injected into coils near the exterior leading edge of the steel tag (e.g., the "raw material side" of the leading edge of the steel tag), then a vertical and horizontal pulling force may be created against this leading edge. Persons skilled in the art will appreciate that this vertical pulling force may be cancelled by the vertical pushing force provided by the copper tag. Thus, only a horizontal pulling force remains. As a result, the raw material is less likely to make contact with a magnetic tile as the raw material moved about the fabrication platform.

To clamp a tag down against a platform, one or more magnetic tiles may be injected with a relatively HIGH DC signal. Stops may be placed about a platform or near a tool in order to aid in the correct positioning of a piece of raw material with respect to a tag embedded/attached to the raw material. Such stops may be mechanically deployed and pressed against, for example, all four sides of the work piece so that the layout of the work piece on the platform is known. Alternatively, a tag may be significantly larger than a coil (e.g., 20 coils may cover the same surface area of a platform as a tag). In this manner, the layout of the tag (e.g., the tag's footprint) on the platform may be sensed. If the raw material is, for example, embedded with a tag in a predetermined layout (e.g., in a layout relative to the raw material), then processing circuitry may be utilized to determine the layout of the material based on the predetermined relationship. As yet another alternative, the tag may be of a non-symmetrical shape (e.g., a rectangle) instead of a symmetrical shape (e.g., a square or circle). The non-symmetry of the tag may correspond to the non-symmetry of the raw material (e.g., the tag may be of the same width as a work piece, but only a fraction of an inch long). In this manner, sensing the edge of a tag may, for example, correspond to the edge of a piece of lumber.

Alternatively, different types of the same material (e.g., steel), or different materials, may be utilized for particular tags for particular pieces such that a different phase shift occurs for that tag with respect to other tags. Such a tag may therefore provide a unique ID for a particular piece of material which may, in turn, aid in identifying pieces (e.g., specific to types of pieces) when putting together a structure such as a truss. Such a tag, or a relatively larger tag, may be placed directly in the middle of a piece of raw material so that the middle of the raw material is known. Smaller tags may be uniformly spaced from a center tag such that, for example, the length of the raw material can be approximated from the center. One or more processing circuits may be utilized to carry out any of the above such methods/systems. Additionally, the distance between tags (or a pattern of tags) may be utilized (e.g., by processing circuitry) to identify a particular piece (or type) of raw material.

Persons skilled in the art will appreciate that the term "raw material" is used loosely in this specification. A raw material may be any material or structure in which a tag may be affixed to or embedded in. Such tags may be embedded into a material, for example, by providing teeth in the tag. In this manner, a tag may be pressed onto a material by a pressing machine so that the teeth firmly grip the material. At the end of the manufacturing process, a magnetic tile (or just a tag sensor) may be autonomously driven on a platform over/beneath a finished structure to sense such a tag. A tag-removing machine may be aligned a particular distance away from the magnetic tile such that one a tag is sensed, the platform is moved a particular distance to align the machine with the tag-removing machine. In this manner, tags may be removed from a truss after a truss has been fabricated. Alternatively, tags may just remain attached to a completed structure (e.g., a completed truss).

Persons skilled in the art will appreciate that the present invention is generally related to autonomous methods of building structures with raw materials. Systems and methods that do not rely on tags and magnetic tiles may be utilized to build, for example, roof trusses. For example, apertures 530 may be provided in a tile or on a platform. Such an aperture 530 may, for example, either exhale or inhale air. Such apertures may be utilized to move a material or structure along a tile or platform. A source of air may be provided to route air through such apertures. Coils may still be utilized to sense tags on a material or to provide additional force against said tags for movement purposes. Such routed air may also be utilized to cool conducting coils as the coils may heat up from passing current through the coils.

Persons skilled in the art will also appreciate that numerous types of building materials used as work pieces on an automated platform. For example, piping and wiring may be moved about the automated platform electromagnetically by attaching a tag to the piping or wiring. Similarly, the location of piping and wiring on the automated platform may be sensed by attaching a tag to the piping or wiring.

Alternatively, however, some of the apertures 530 may be replaced with a light-sensor (e.g., a photo-transistor, photo-resistor, or photo-diode). White paint may be painted on a raw material, or a portion of the raw material. In this manner, such a light-sensor may sense the white portion of a raw material. To enhance the vision of the system, the rest of the material may be painted a darker color (e.g., black). Alternatively, a local positioning network may be placed about the platform. Circuitry cable of receiving positioning signals, processing positioning signals, and transmitting circuitry position may be utilized to locate a raw material or structure in which such circuitry is attached/embedded.

Figure 6:
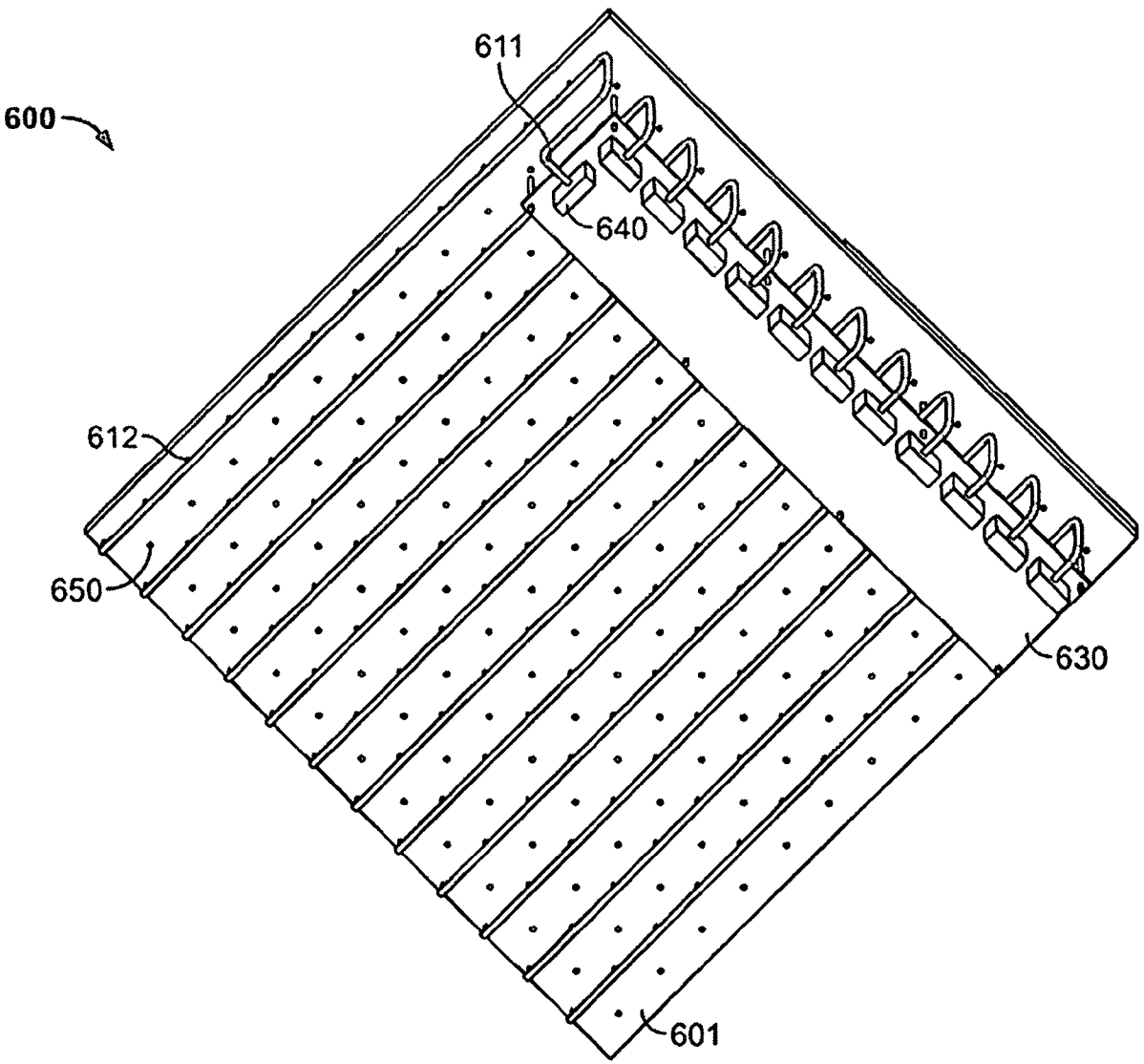
FIG. 6 is an illustration of another magnetic tile constructed in accordance with the principles of the present invention.

FIG. 6 shows the underside of one embodiment of a magnetic tile constructed in accordance with the principles of the present invention. Particularly, FIG. 6 shows tile 600 that may include plate 601, bus wiring 611, leads 612, circuitry board 630 and related circuitry 640. Tile 600 may include other components such as, for example, apertures 650. The sheets and protective coverings of a tile may be fixed together, for example, by glue or another type of adhesive.

Figure 7:
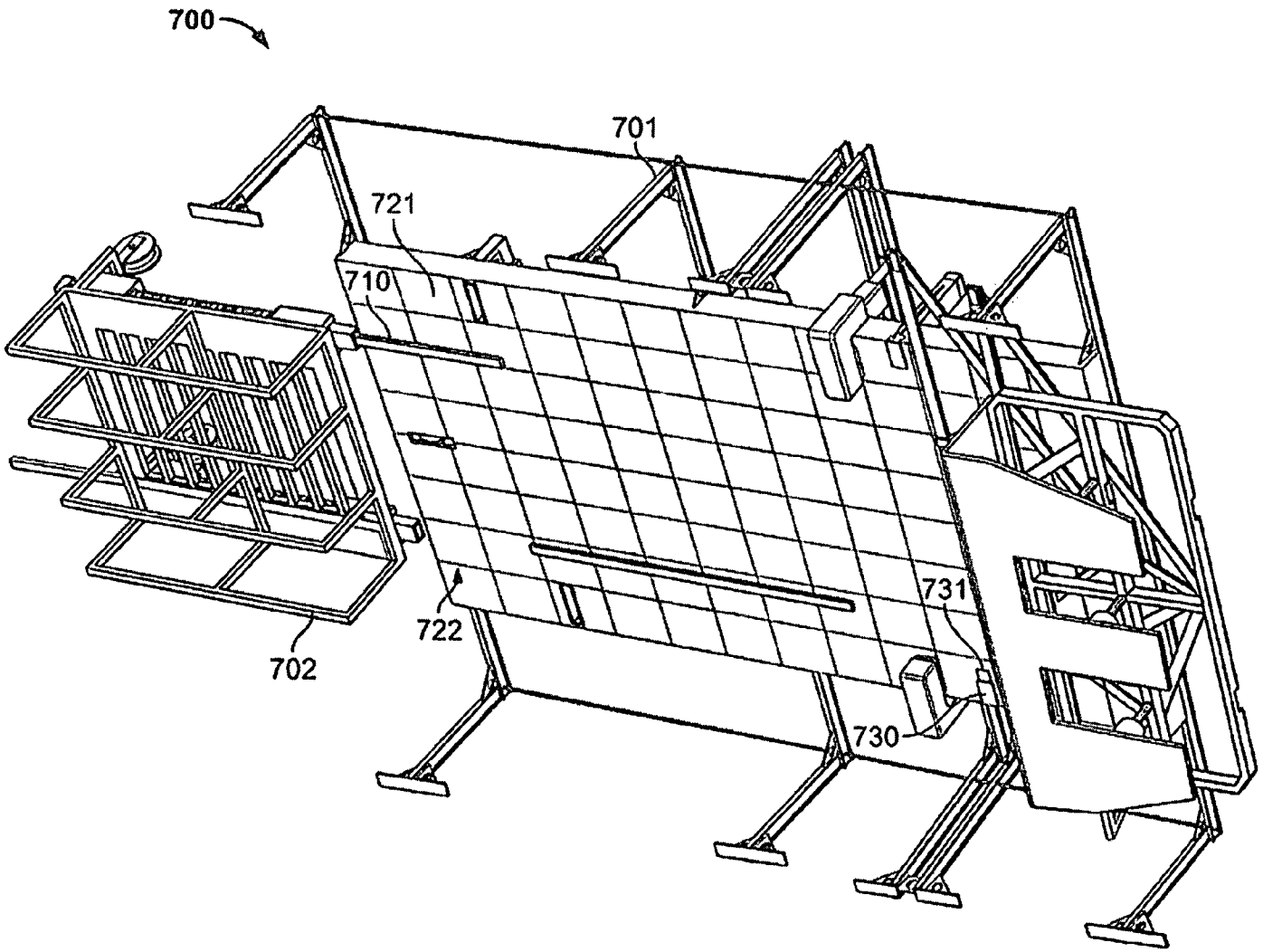
FIG. 7 is an illustration of a suspended truss fabrication system constructed in accordance with the principles of the present invention.

FIG. 7 shows suspended (i.e., inverted) fabrication process 700 in which tagged materials 710 can be controlled, against gravity, by any number of magnetic tiles 721 located on platform 722. Tagged materials 710 may be moved anywhere on platform 722. Additional materials, such as connectors 731 fed to platform 722 by connector feeding machine 730 may moved anywhere on platform 722. Platform 722 may be suspended, or held up, by multiple legs such as leg 701. Additional components may stand upright on the floor via legs such as legs 702. In this manner the material feeding and/or tagging machine of FIG. 7 may be similar to, for example, the material feeding and/or tagging machine of FIG. 4.

Figure 8:
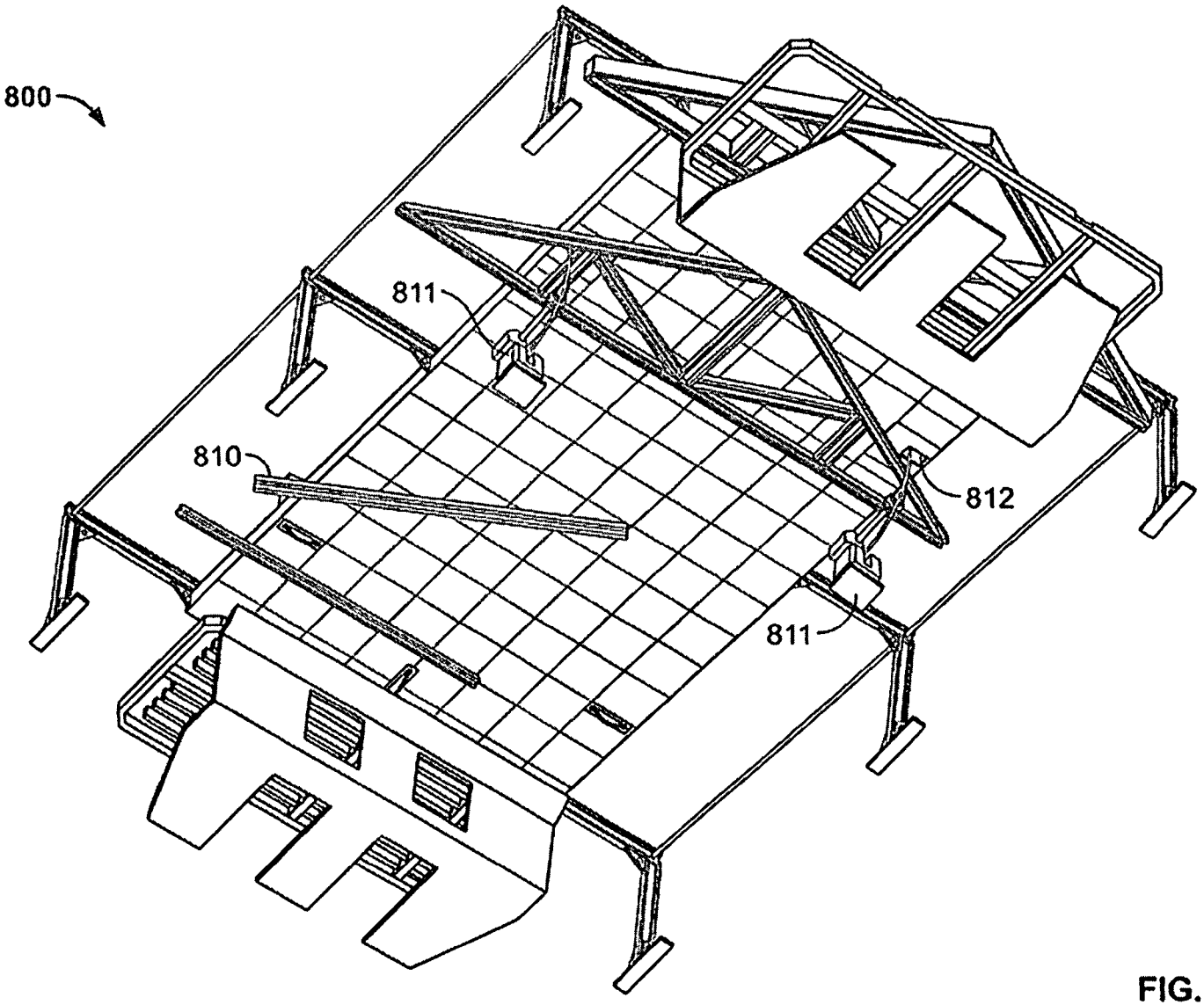
FIG. 8 is an illustration of another suspended truss fabrication system constructed in accordance with the principles of the present invention.

As mentioned above, steel may be utilized as materials on an electromagnetic-based fabrication system without utilizing steel tags. A steel based system may be upright or inverted. FIG. 8 shows inverted (i.e., suspended) system 800 constructed in accordance with the principles of the present invention. Steel material 810 may be moved by magnetic tiles located on a platform. For example, steel material 810 may be moved to steel-related tools 811 and clasped down by one or more magnetic tiles while steel-related tools 811 are operating. Steel related tool 811 may be, for example, a welding device located near well 812. Well 812 may receive waste steel shards and chips from the welding process.

Figure 9:
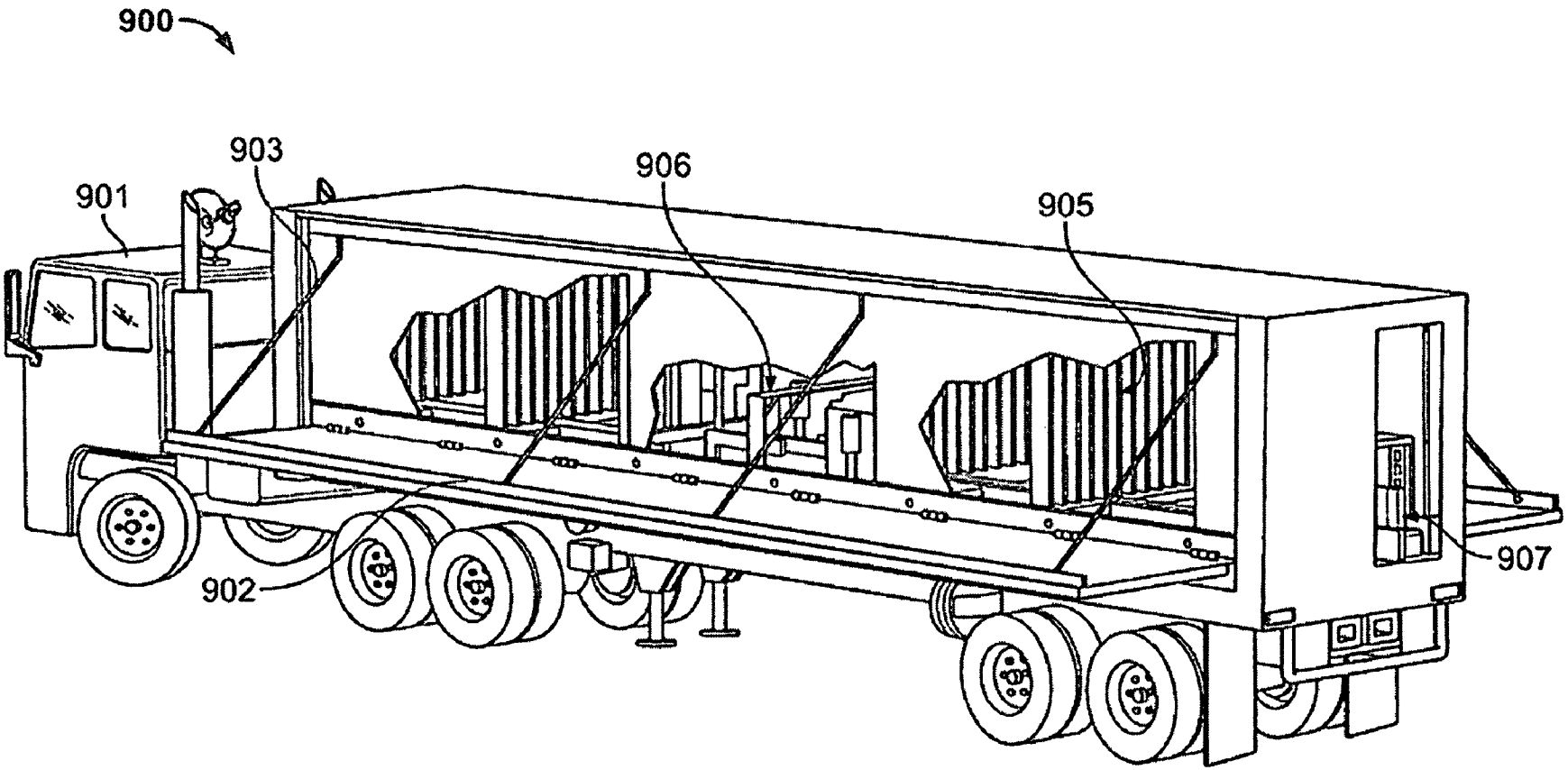
FIG. 9 is an illustration of a mobile truss fabrication system constructed in accordance with the principles of the present invention.

FIG. 9 shows truck 901 that includes a mobile fabrication system such as a truss fabrication system. Particularly, truck 901 includes foldout platform 902 that may include a configuration of magnetic tiles. Such a platform may be dispended from truck 901 via one or more retractable fasteners 903. Fasteners 903 may be manually removed from a securing portion of platform 902 after platform 902 is dispersed. Fasteners 903 may then, for example, automatically retract into truck 901. Control circuitry 907 may be included in truck 901 to control and monitor the autonomous set-up of the mobile fabrication system. Control circuitry 907 may also be utilized manually to set-up the mobile fabrication system. Additional fabrication components 906 may be included in truck 901. Such components may be automatically placed around portions of platform 902.

Persons skilled in the art will appreciate that platform 902 runs from the left-side of truck 901, through truck 901, to the right-side of truck 901. Furthermore, components 906 may be stationary in, for example, the middle of truck 901. Space 905 may be utilized to store raw materials that may be utilized by truck 901. Preferably, such raw materials are tagged such that a processing step is removed from mobile fabrication system 901. In this manner, tagging devices do not have to be transported which, in turn allows for more raw material to be transported which, in turn, allows for more structures (e.g., trusses) to be build by a mobile fabrication system. Truck 901 may include, for example, a wireless receiver and related signal processing circuitry.

Figure 10:
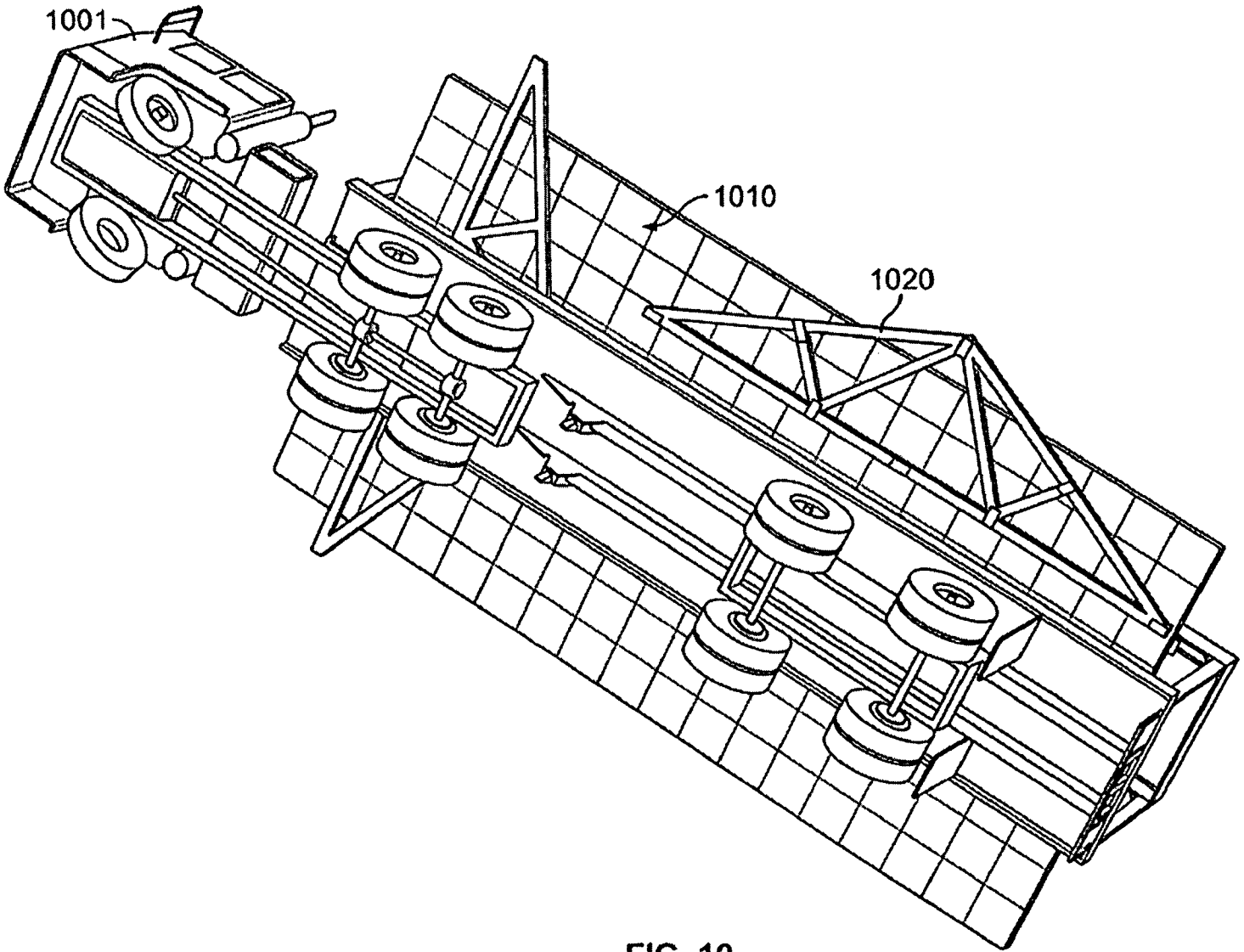
FIG. 10 is an illustration of the underside of an expanded mobile fabrication system constructed in accordance with the principles of the present invention.

FIG. 10 shows an inverted mobile fabrication system 1000 included in truck 1001. Such a mobile fabrication system may operate similarly to inverted system 700 of FIG. 7 and system 800 of FIG. 8. In this manner, mobile fabrication system 1000 may include platform 1010. Persons skilled in the art will appreciate that completed structure 1020 (e.g., a truss) may be steadily clamped and manipulated to a portion of platform 1010 that extends from truck 1001 without having completed structure 1020 dissect (i.e., extend) a portion of the interior of truck 1001.

In this manner, the interior of truck 1001 does not have to include a portion of platform 1010. The interior of truck 1001 may, in this manner, include fabrication components about the perimeter of the exterior of truck 1001. Furthering this example, platform 1010 may only need to extend from one side of truck 1001 or may be located in only a portion of the interior of truck 1001.

Figure 11:
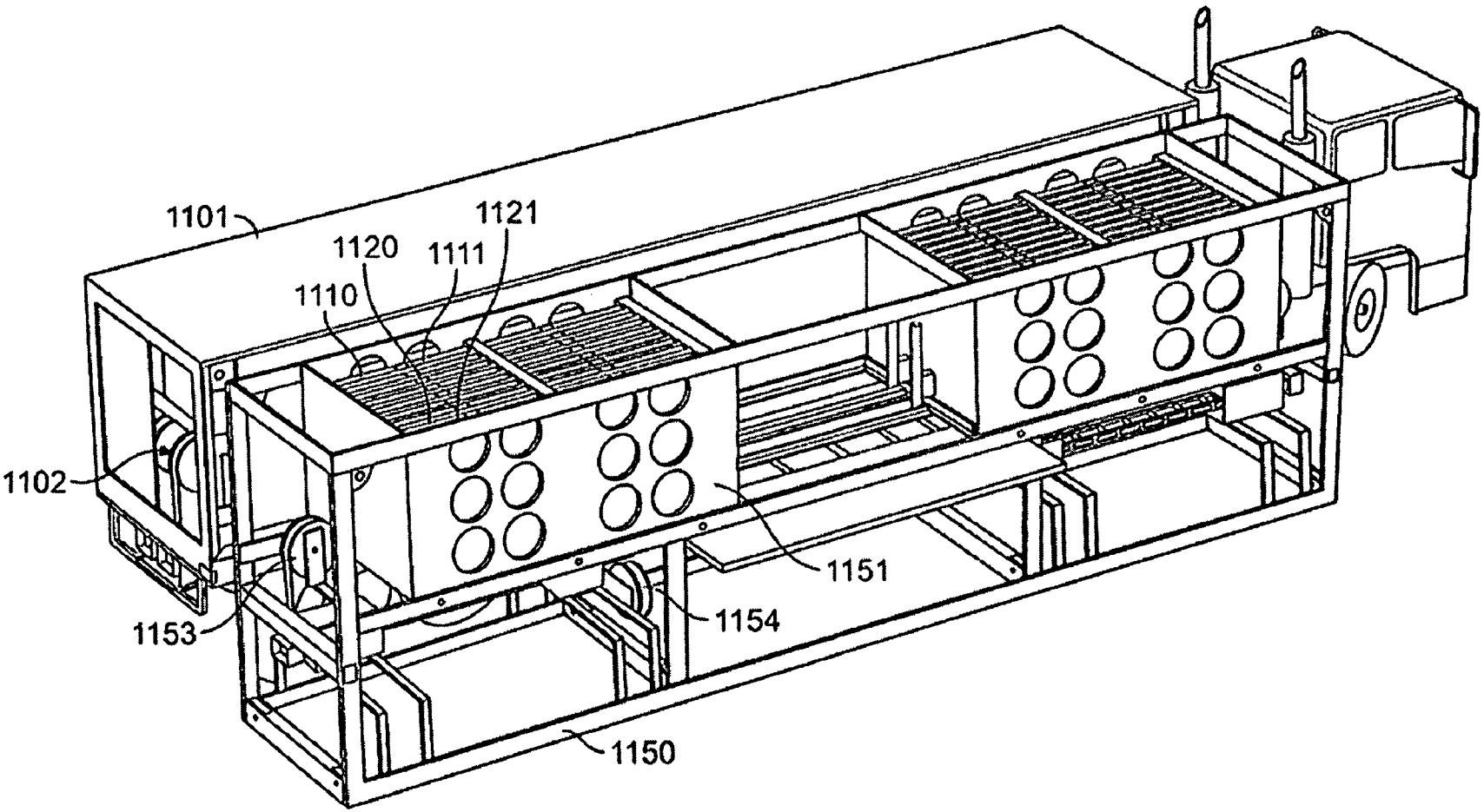
FIG. 11 is an illustration of a raw material supply dock and truck constructed in accordance with the principles of the present invention.

FIG. 11 shows a material refilling system in which truck 1101 is refilled with raw materials 1110 and 1120 included in storage bin 1151. Particularly storage bins 1151 may be placed on stationary refilling station 1150. Such placement may occur manually or autonomously. One autonomous example includes sensing if storage bin 1151 is empty or if storage bin 1151 is not present (i.e., was picked up by truck 1101) and either refilling storage bin 1151 with raw material or providing a new, filled, storage bin 1151 to refilling station 1150. One or more motors and one or more communication systems (not shown), such as wireless communication systems, may be utilized in such a process.

Storage bins 1151 may hold a number of raw materials 1110. Such raw materials may already be tagged such that a tagging device does not have to be transported in a mobile fabrication facility. As a result, tagging devices 1153 and 1154 may be located in, or near, refilling station 1150. Such a tagging system may put any type of tags on a raw material. For example, copper tag 1111 may be placed on material 1110 and a steel tag 1121 may be placed on material 1120. Processing circuitry may record what type of tag was placed on a particular material and communicate (e.g., through a wireless network) such information to a mobile fabrication facility or remote database accessible by the mobile fabrication facility. A variety of different types of tags (e.g., differently sized tags or tags of different materials) may be placed on a single raw material. Additionally, different types of raw materials may be included in storage bin 1151 and this information may be communicated, in some manner, to a remove fabrication facility.

For example, each raw material member in bin 1151 may be associated to a particular bin position. Bin 1151 may sense what type of material is being used. For example, if a magnetic tile was present in refilling station 1150, then a mechanical button may tell station 1150 when a raw material is ready to be sensed. The magnetic tile may then attempt to sense a phase shift by providing a relatively LOW AC voltage/current to the material. If no phase shift occurs, then the material may be determined to be of a particular type (e.g., wood). Yet, if a phase shift does occur, then the material may be determined to be of a different type (e.g., steel). Such a sensing device may be included, for example, before the raw material is tagged. In doing so, a type of material may be recorded as being in a particular bin position. If the mobile fabrication facility is required to build a structure using more than one raw material, such a facility may selectively disperse the needed material from bin 1151 to do fabricate the structure. Additionally, bin 1151 may include magnetic tiles to sense and move raw materials to, from, and within bin 1151.

Persons skilled in the art will appreciate that refilling station 1150 may be utilized to fill a raw material transportation truck or a truck carrying a mobile fabrication facility.

Figure 12:
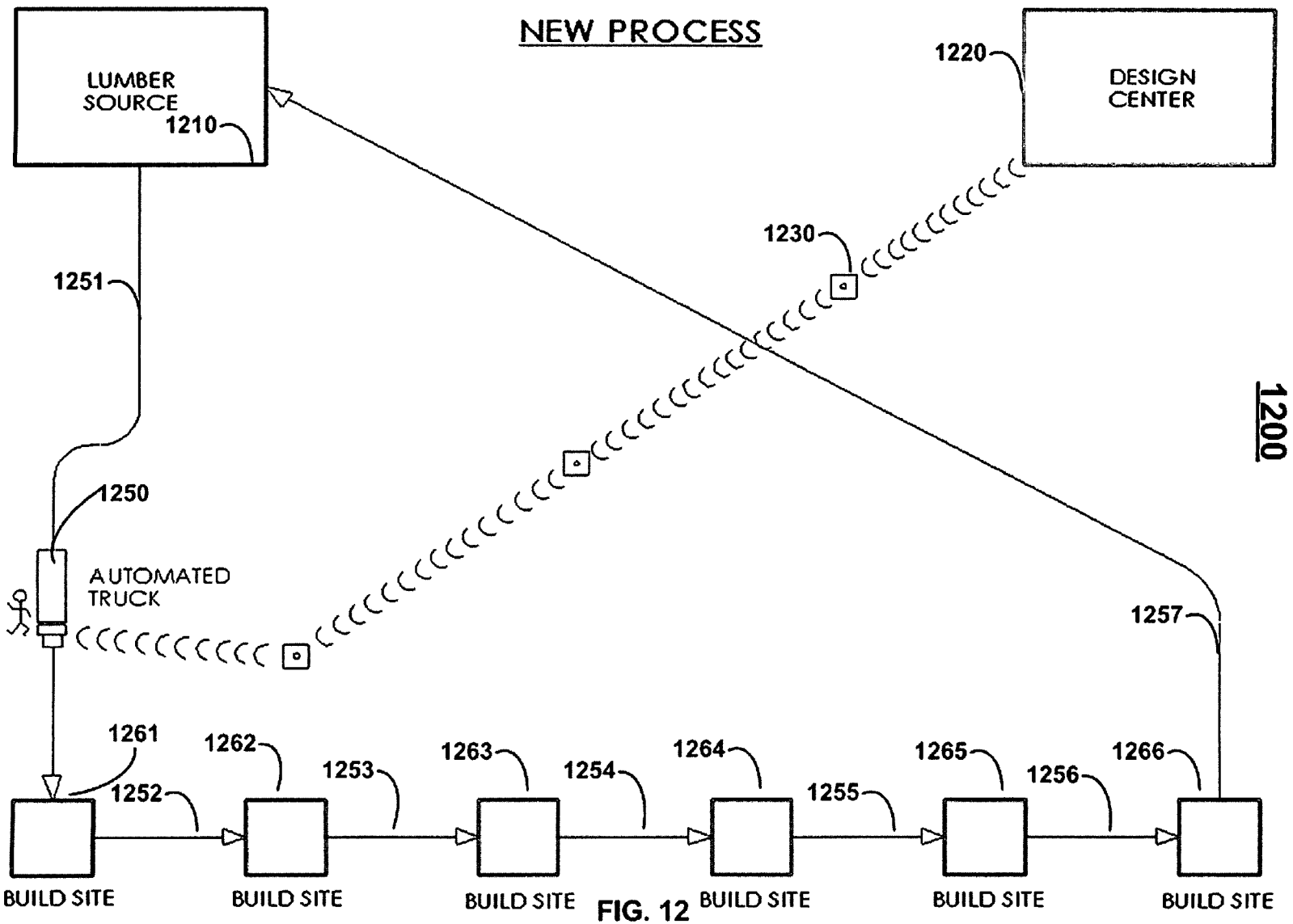
FIG. 12 is an illustration of a truss fabrication and distribution process constructed in accordance with the principles of the present invention.

FIG. 12 shows production process 1200 in which an automated truck 1250 (a truck carrying a mobile fabrication facility) picks up lumber from lumber source 1210, receives commands from design center 1220, and follows a path to multiple building sites. Truck 1250 may follow, for example, predetermined path 1251 to site 1261. At site 1261, a mobile fabrication facility may be set-up and structures needed by build site 1261 may be fabricated. The design of such structures may be provided either manually through on-site input, autonomously through memory located on truck 1250, or may be provided via design center 1220 (either manually or autonomously). Such communications may be, for example, wireless communications routed through network 1230. After the truck 1250 has been utilized at build side 1261, truck 1250 may be manually driven to the next build site or instructions may be provided to truck 1250 that the next build site is build site 1262. Truck 1250 may then travel path 1252 to build site 1262. In this manner, truck 1250 may visit multiple build sites 1262-1266 through paths 1252-1256 and return to lumber source 1210 when truck 1250 has run out of raw materials. Alternatively, a truck containing only raw materials may be dispatched to automated truck 1250 when automated truck 1250 is running low on raw materials, or has no raw materials. Such a refilling truck may house raw materials that could fill multiple trucks 1250. Design center 1220 could, in this manner, provide a set of directions to such a refilling truck such that multiple automated trucks are refilled.

Figure 13:
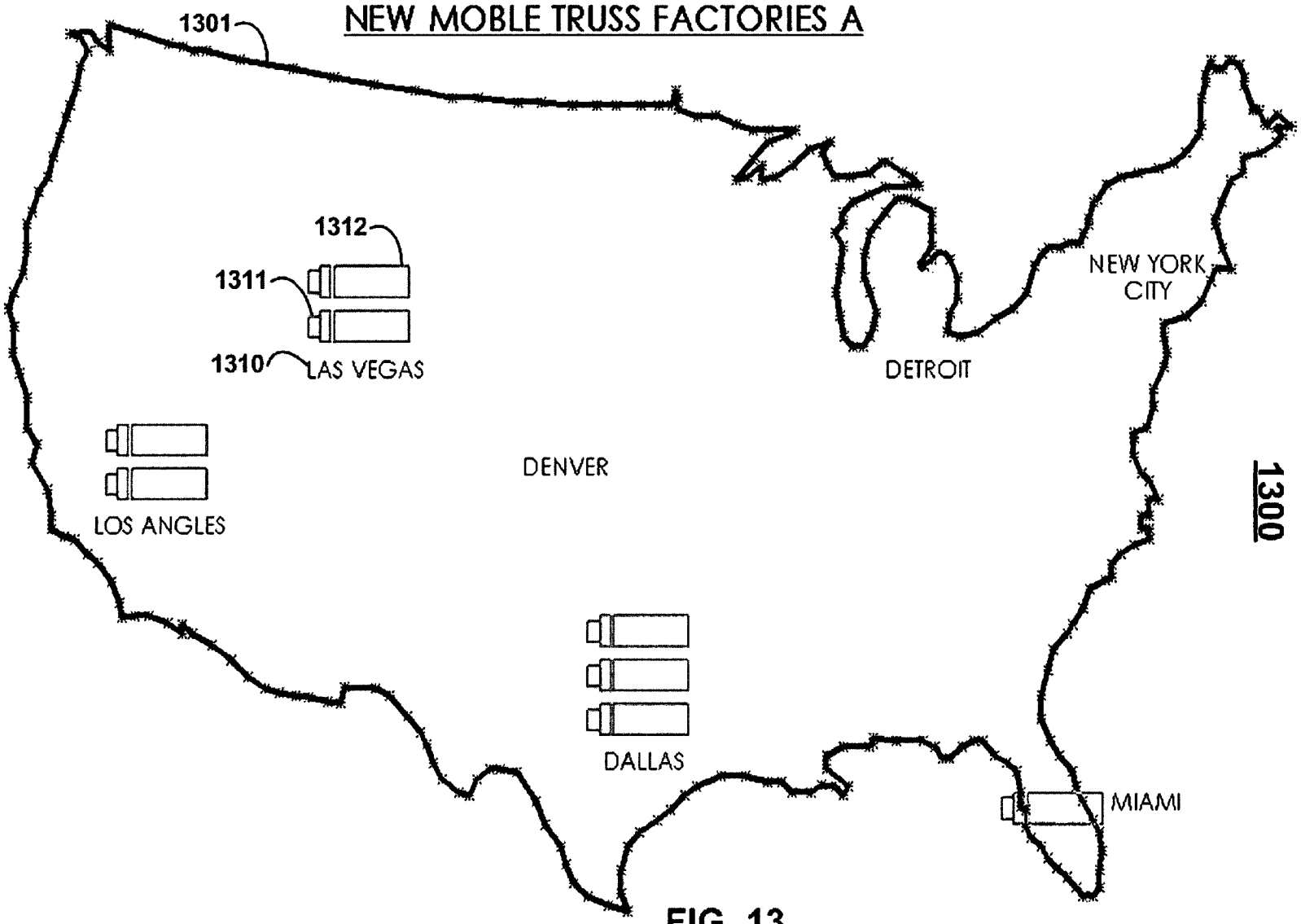
FIG. 13 is a topology of possible mobile fabrication system locations, constructed in accordance with the principles of the present invention, in the United States.
Figure 14:
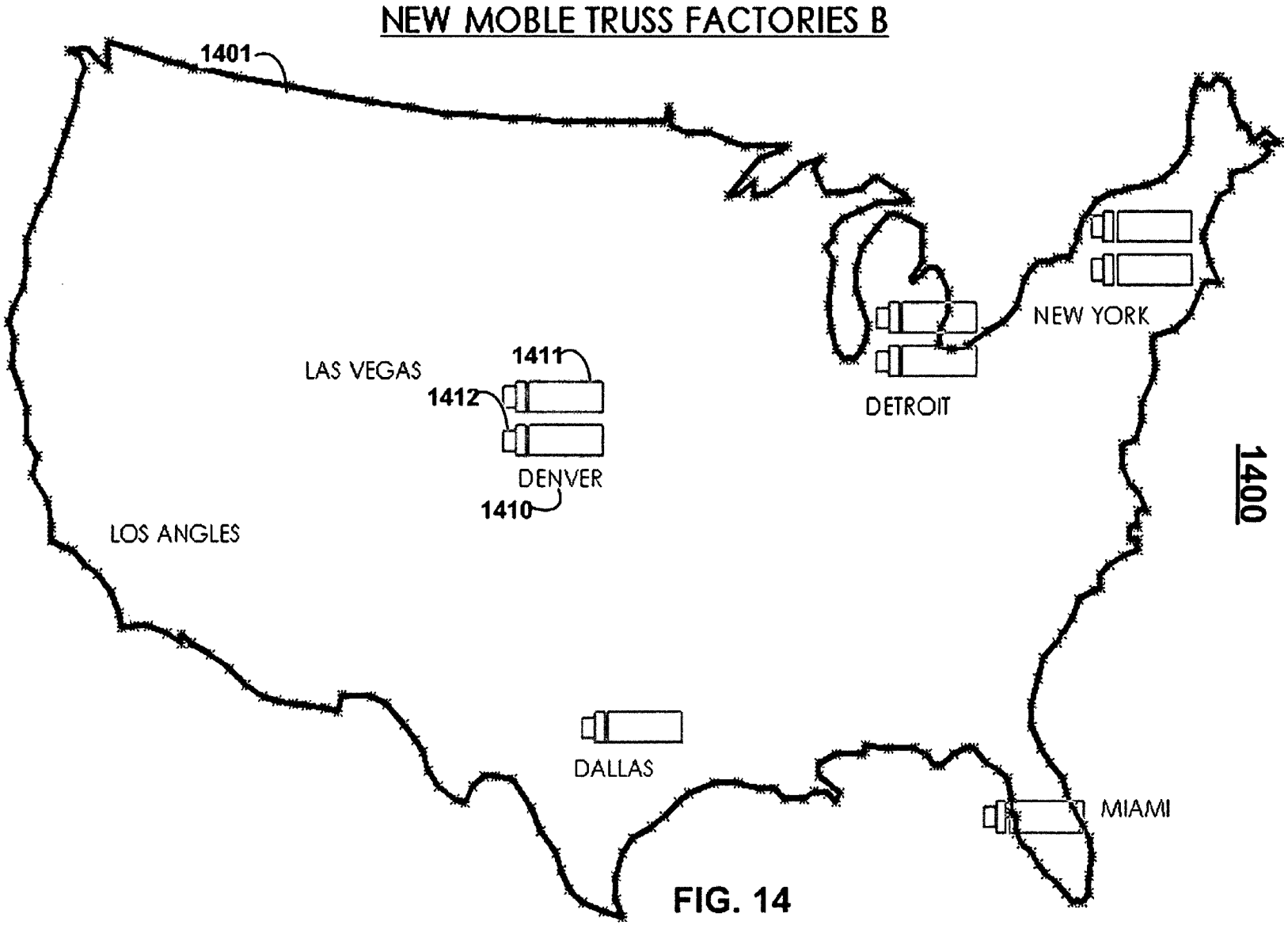
FIG. 14 is another topology of possible mobile fabrication system locations, constructed in accordance with the principles of the present invention, in the United States.

FIG. 13 shows topology 1300 that includes map 1301 in which trucks 1312 and 1311 are stationed in area 1310. Trucks 1312 and 1311 may be, for example, be either refilling trucks or trucks housing an automated fabrication system. FIG. 14 shows topology 1400 that includes map 1401 in which trucks 1412 and 1411 are stationed in area 1410. Trucks 1412 and 1411 may be, for example, either refilling trucks or trucks housing an automated fabrication system. In this manner, FIGS. 13 and 14 show the versatility of using a system based on mobile fabrication systems. For example, certain areas require more building during certain times of the year than others. Refilling trucks and trucks housing a mobile production facility may be positioned near areas with a high fabrication demand at any time.

Also, there are additional and alternative embodiments and components constructed in accordance with the principles of the present invention. For example, there are alternate embodiments/perspectives of refill containers, raw material loading procedures of material onto a truck or refill container, truck payload bays, tagging and loading raw materials onto a truck, truck configurations, truck assembly processes, adjustable press lines, adjustable saws, cutting processes, plate dispensers, pressing processes, a truss assembly line and an associate process, translation processes, and truss connector plate configurations and method of utilization.

From the foregoing description, persons skilled in the art will recognize that this invention provides automated fabrication systems that may be provided in a stationary or mobile format. In addition, persons skilled in the art will appreciate that the various configurations described herein may be combined without departing from the present invention. For example, a mobile fabrication system does not have to be inverted, but may operate similar to system 400 of FIG. 4. It will also be recognized that the invention may take many forms other than those disclosed in this specification. For example, structures may be fabricated while the mobile fabrication system is in transportation. In such an embodiment, only the interior of the automated truck is utilized to build structures. Accordingly, it is emphasized that the invention is not limited to the disclosed methods, systems and apparatuses, but is intended to include variations to and modifications therefrom which are within the spirit of the following claims.

What is claimed is:

1. A method of building a truss structure using a mobile fabrication facility comprising an automotive wheeled vehicle, the automotive wheeled vehicle comprising a platform, wherein the mobile fabrication facility is operable to travel from a first location to a second location comprising a building construction site, the method comprising:

receiving instructions at the mobile fabrication facility, wherein the instructions comprise a particular truss structure; and utilizing the instructions to build the particular truss structure with the mobile fabrication facility, wherein the step of utilizing the instructions to build the particular truss structure includes moving a raw material stored within the mobile fabrication facility across at least a portion of the platform by actions including electromagnetically interacting with a tag on the raw material from the platform.

2. The method of claim 1, wherein the automotive wheeled vehicle comprises a truck.

3. The method of claim 1, wherein the mobile fabrication facility includes a wireless receiver.

4. The method of claim 1, further comprising:

transmitting the instructions from a remote base-location to the mobile fabrication facility.

5. The method of claim 4, wherein transmitting the instructions comprises:

transmitting the instructions via one of the Internet, a wireless network, WiFi, a radio transmission, an infrared transmission, a cellular transmission, and satellite communication.

6. The method of claim 1, wherein the instructions further comprise directions to move the mobile fabrication facility from the first location to the second location and to build the particular truss structure at the second location.

7. The method of claim 1, wherein the instructions further comprise one of safety constraints and communication protocols.

8. The method of claim 1, wherein the mobile fabrication facility is operable to store a plurality of the raw materials, and wherein:

utilizing the instructions to build the particular truss structure comprises building the particular truss structure with the raw materials.

9. The method of claim 8, wherein the instructions further comprise directions to move the mobile fabrication facility to the second location to refill the raw materials at the second location.

10. The method of claim 1, further comprising:

determining a particular truss building process from a plurality of truss building processes, wherein the particular truss building process corresponds to the particular truss structure.

11. The method of claim 10, wherein the particular truss building process comprises a list of machine process steps.

12. The method of claim 10, wherein:

the plurality of truss building processes are stored in a database; and the plurality of truss building processes are updated at the occurrence of a particular event.

13. The method of claim 12, wherein the particular event is one of a particular time of day, a particular component of the mobile fabrication facility being turned on, and receipt of a notification that an update is available.

14. The method of claim 12, wherein the database is a remote database external to the mobile fabrication facility.

15. The method of claim 1, wherein the mobile fabrication facility further comprises fabrication components for building the particular truss structure.

16. The method of claim 1, wherein the platform comprises at least one magnetic tile that electromagnetically interacts with the tag.

17. The method of claim 16, wherein the moving of the raw material across at least a portion of the platform comprises:

repelling the tag from the platform with electromagnetic forces between the at least one magnetic tile and the tag.

18. The method of claim 16, wherein the moving of the raw material across at least a portion of the platform comprises:

clasping the tag to the platform with electromagnetic forces between the at least one magnetic tile and the tag.

19. The method of claim 16, wherein the moving of the raw material across at least a portion of the platform comprises:

sensing the position of the raw material relative to the platform with electromagnetic forces between the at least one magnetic tile and the tag.

20. The method of claim 1, wherein the platform comprises at least a portion of a side of the mobile fabrication facility, and wherein the moving of the raw material across the platform comprises:

lowering the at least a portion of a side into a horizontal position; and securing the at least a portion of a side.

* * * * *